US007871073B2

(12) United States Patent
Noguchi et al.

(10) Patent No.: US 7,871,073 B2
(45) Date of Patent: Jan. 18, 2011

(54) SHEET CONVEYING DEVICE, AND IMAGE FORMING APPARATUS INCLUDING SAME

(75) Inventors: Hidetaka Noguchi, Tokyo (JP); Hiromichi Matsuda, Tokyo (JP); Toshiyuki Andoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 436 days.

(21) Appl. No.: 11/907,543

(22) Filed: Oct. 15, 2007

(65) Prior Publication Data

US 2009/0026689 A1 Jan. 29, 2009

(30) Foreign Application Priority Data

Oct. 13, 2006 (JP) ..... 2006-279413

(51) Int. Cl.
*B65H 7/02* (2006.01)

(52) U.S. Cl. ..... 271/265.01; 271/265.02; 271/270

(58) Field of Classification Search ..... 271/265.01, 271/265.02, 265.04; 399/68, 45
See application file for complete search history.

(56) References Cited

U.S. PATENT DOCUMENTS 5,519,478 A * 5/1996 Malachowski ..... 399/68
5,983,066 A * 11/1999 Abe et al. ..... 399/394
6,370,354 B1 * 4/2002 Chapman et al. ..... 399/394
6,374,075 B1 * 4/2002 Benedict et al. ..... 399/395
6,761,351 B1 * 7/2004 Howe ..... 271/3.15
7,036,811 B2 * 5/2006 Howe ..... 271/3.13

FOREIGN PATENT DOCUMENTS

| | | |
|---|---|---|
| JP | 2000-330353 | 11/2000 |
| JP | 2001-265090 | 9/2001 |
| JP | 2003-029569 | 1/2003 |
| JP | 2003-215870 | 7/2003 |
| JP | 2004-109706 | 4/2004 |
| JP | 2005-107118 | 4/2005 |
| JP | 2006-085153 | 3/2006 |
| JP | 2006-154739 | 6/2006 |

* cited by examiner

*Primary Examiner*—Kaitlin S Joerger
(74) *Attorney, Agent, or Firm*—Harness, Dickey & Pierce, P.L.C.

(57) ABSTRACT

A sheet conveying device, that can be included in an image forming apparatus, includes a drive source, a drive roller driven by the drive source, a driven roller to press against the drive roller and rotate with the drive roller, an angular velocity detector to detect an angular velocity of the drive roller, a timing estimation unit to estimate a timing when a sheet-type recording medium enters between the drive roller and the driven roller, and a controller to control the drive source based on detection results obtained by the angular velocity detector. The controller includes a feedback control unit to perform feedback control based on data obtained by the angular velocity detector, and a feed-forward control unit to perform feed-forward control based on data obtained by the timing estimation unit.

17 Claims, 10 Drawing Sheets

SHEET CONVEYING DEVICE, AND IMAGE FORMING APPARATUS INCLUDING SAME

PRIORITY STATEMENT

The present patent application claims priority under 35 U.S.C. §119 from Japanese Patent Application No. 2006-279413 filed on Oct. 13, 2006, the contents and disclosures of which are hereby incorporated by reference herein in their entirety.

BACKGROUND

1. Field

Example embodiments of the present patent application generally relate to a sheet conveying device and an image forming apparatus including the sheet conveying device. More particularly, the present patent application relates to a sheet conveying device conveying a sheet-type recording medium between a drive roller and a driven roller contacting the drive roller with pressure, and an image forming apparatus including the sheet conveying device therein.

2. Discussion of the Related Art

Electrophotographic image forming apparatuses rotate a drum-shaped or belt-shaped photoconductor to charge a surface thereof and optically write an electrostatic latent image on the surface. Toner is supplied to develop the electrostatic latent image to a toner image, which is transferred onto a recording medium directly from the photoconductor or via a belt-shaped intermediate transfer member to print the toner image on the recording medium.

Color image forming apparatuses include one or more photoconductors to sequentially transfer respective single color toner images formed thereon onto an intermediate transfer member to form a composite color image, which is then transferred onto a recording medium.

Image forming apparatuses employing an intermediate transfer member can convey various types of recording media, such as thin papers, thick papers, postcards, and envelopes, thereby providing a wide range of recording medium transferability. Generally, a drum-shaped intermediate transfer member or a belt-shaped intermediate transfer member is most widely used.

In general, the intermediate transfer member is driven at a constant speed through various areas and units for image forming, including a primary transfer area, in which respective single color toner images are sequentially transferred onto an intermediate transfer member to form a composite toner image, and a secondary transfer area in which the composite toner image is transferred from the intermediate transfer member onto a recording medium. However, when a recording medium having a certain critical thickness enters the secondary transfer area, the speed of the intermediate transfer member may decrease for a short period of time. Accordingly, an intermediate transfer unit including the intermediate transfer member may transmit a brief decrease in speed caused in the secondary transfer area and cause deviations or defects in images in the primary transfer area.

In addition, a trend toward downsizing color image forming apparatuses causes a secondary transfer unit located at the secondary transfer area and a fixing unit located at a fixing area to be disposed close to each other, so that a secondary transfer operation and a fixing operation can be conducted simultaneously. In such a configuration, however, the fixing unit suffers from the same drawback as the intermediate transfer unit. Specifically, when a sheet-type recording medium having a certain thickness enters the secondary transfer area, a fixing roller or belt driven at a constant speed in the fixing unit may experience a brief decrease in speed, thereby transmitting the brief decrease via the fixing unit and causing deviations or defects in images in the secondary transfer area.

In short, a thick sheet-type recording medium causes a short-term decrease in speed of an intermediate transfer drum, an intermediate transfer belt, a fixing roller, and/or a fixing belt when the sheet-type recording medium enters a secondary transfer area or a fixing area.

To eliminate the above-described drawbacks, a feed-forward control may be conducted to maintain a belt member moving at a constant speed. In feed-forward control, a speed of a drive source driving a belt member formed in a closed loop is controlled at a preset, reference timing, in a preset, reference amount, and for a preset, reference period of time so as to correct any decrease in speed of the belt member when such a thick paper enters a transfer unit.

However, changes in the amount of such speed control are abrupt, and can be modeled as rectangular waveforms.

A different sort of control may also be conducted to reduce a decrease in the speed of the fixing roller when a thick sheet of paper enters the fixing unit. In this control, a thickness of a sheet-type recording medium is detected in advance and a force applied to a pressure roller of the fixing unit is adjusted according to the detected thickness.

However, such control requires an additional mechanism to adjust the pressing force, which causes an increase in costs. In addition, it is mechanically difficult to accurately control the pressing force.

SUMMARY

In light of the foregoing, the inventors of the present patent application previously propose to provide a sheet conveying device and an image forming apparatus including a sheet conveying device that can eliminate the drawbacks of the above-described techniques, specifically, by providing a sheet conveying device that is compact and space-saving, that includes a simple configuration achieved at low cost, that can handle various types of sheets, and that can reserve or secure sufficient distance and space for bending a leading edge of a sheet, and an image forming apparatus that includes such sheet conveying device.

One or more embodiments of the present patent application has been made, taking the above-described circumstances into consideration.

An embodiment of the present patent application provides a sheet conveying device that includes a drive source, a drive roller driven by the drive source, a driven roller to press against the drive roller and rotate with the drive roller, an angular velocity detector to detect an angular velocity of the drive roller, a timing estimation unit to estimate a timing when a sheet-type recording medium enters a contact point between the drive roller and the driven roller, and a controller to control the drive source based on detection results obtained by the angular velocity detector. The controller includes a feedback control unit to perform feedback control based on data obtained by the angular velocity detector, and a feed-forward control unit to perform feed-forward control based on data obtained by the timing estimation unit.

The feed-forward control unit may include a memory to store data on variations in speed of the drive roller previously obtained by the angular velocity detector at the timing when the sheet-type recording medium enters between the drive roller and the driven roller, and an arithmetic unit to calculate an input value to be inputted to the drive source to remove a variation in speed of the drive roller from the data on variations in speed of the drive roller stored in the memory.

The above-described sheet conveying device may further include a thickness detection unit to detect a thickness of the sheet-type recording medium. The input value calculated by the arithmetic unit to be inputted to the drive source is optimized according to the thickness detected by the thickness detection unit.

The memory may store data of various speed variations of the drive roller corresponding to various sheet-type recording media. Appropriate data of speed variation corresponding to a most closely approximate thickness being output from the data of various speed variations stored in the memory to obtain the input value to be inputted to the drive source according to the thickness detected by the thickness detection unit.

The memory may store data of speed variations of the drive roller corresponding to at least two sheet-type recording media.

Drive roller speed data obtained by the angular velocity detector at the timing when the sheet-type recording medium enters between the drive roller and the driven roller may be stored in the memory, and the data on variations in speed of the drive roller previously stored in the memory may be corrected based on the stored drive roller speed data.

Drive roller speed data obtained by the angular velocity detector at the timing when the sheet-type recording medium enters between the drive roller and the driven roller may be stored in the memory, and the feed-forward control may be performed using the stored drive roller speed data and the data on variations in speed of the drive roller stored in the memory.

Drive roller speed data obtained by the angular velocity detector at the timing when the sheet-type recording medium enters between the drive roller and the driven roller may be stored in the memory multiple times, and the data on variations in speed of the drive roller stored in the memory may be either corrected or expanded according to an average value of the speed data stored multiple times.

At least one embodiment of the present patent application provides an image forming apparatus that includes the above-described sheet conveying device including a fixing unit.

At least one embodiment of the present patent application provides an image forming apparatus that includes the above-described sheet conveying device including an intermediate transfer unit.

BRIEF DESCRIPTION OF THE DRAWINGS

The accompanying drawings are intended to depict example embodiments of the present patent application and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
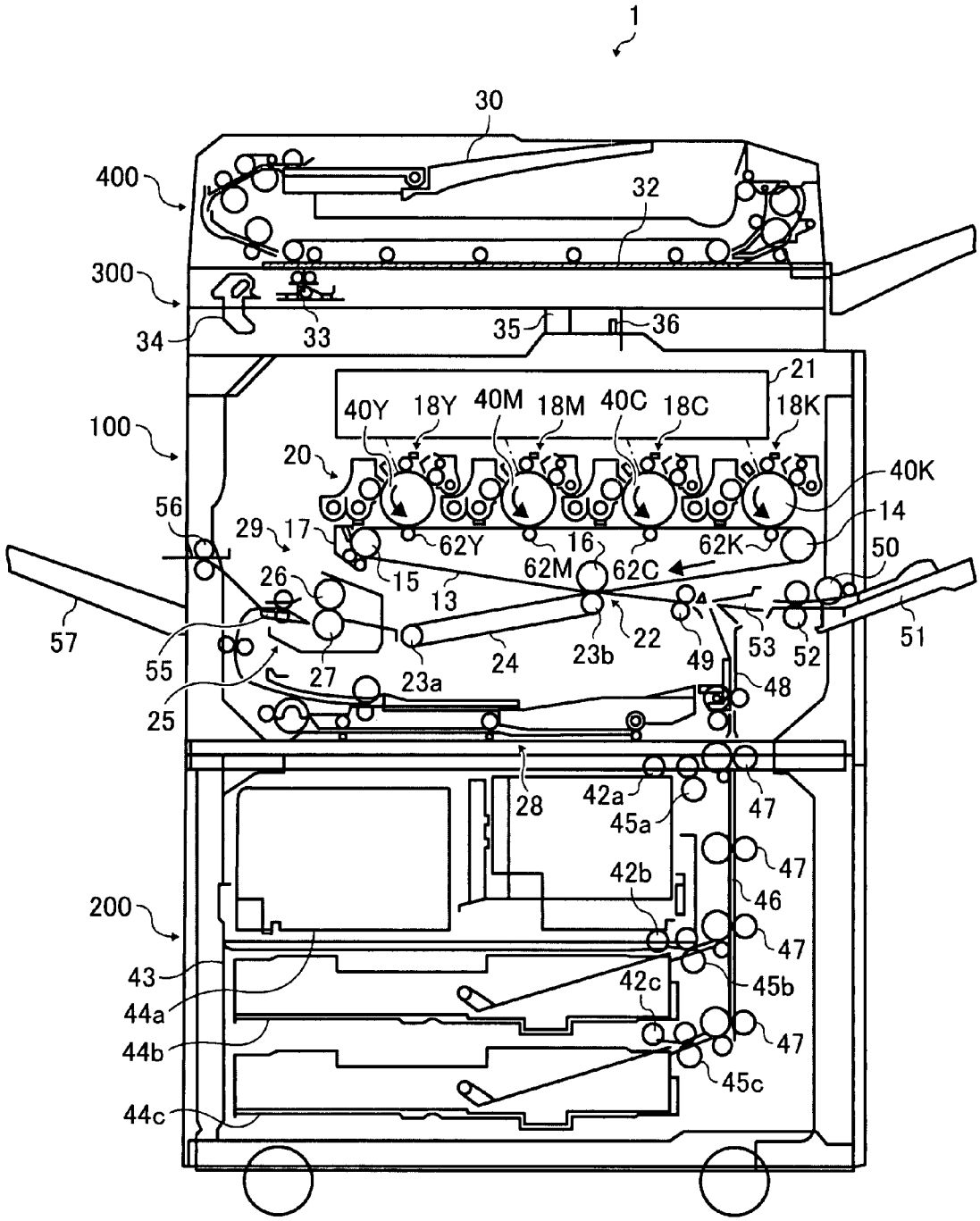
FIG. 1 is a cross-sectional view of a schematic configuration of an image forming apparatus according to an example embodiment of the present patent application.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

Now, example embodiments of the present patent application are described in detail below with reference to the accompanying drawings.

Descriptions are given, with reference to the accompanying drawings, of examples, example embodiments, modification of example embodiments, etc., of a sheet conveying device according to the present patent application, and an image forming apparatus including the same. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of example embodiments of the present patent application.

The present patent application includes a technique applicable to any sheet conveying device. For example, the technique of the present patent application is implemented in the most effective manner in an electrophotographic image forming apparatus including a sheet conveying device. In such an electrophotographic image forming apparatus, an intermediate transfer unit and/or a fixing unit is used as a sheet conveying device.

Among various types of electrophotographic image forming apparatuses, the present patent application explains techniques with a tandem-type image forming apparatus with an intermediate transfer method as representative examples.

Referring to FIG. 1, a schematic configuration of an image forming apparatus 1 according to an example embodiment of the present patent application is described.

In FIG. 1, the image forming apparatus 1 is a tandem-type electrophotographic image forming apparatus with an intermediate or indirect transfer method. The image forming apparatus 1 includes a main body 100 serving as an image forming mechanism, a sheet feeding table 200 serving as a sheet feeding mechanism, an image scanner 300 serving as an image reading mechanism, and an automatic document feeder 400 serving as a document conveying mechanism.

The main body 100 of the image forming apparatus 1 includes an intermediate transfer belt 13, three supporting rollers, which are a first supporting roller 14, a second supporting roller 15, and a third supporting roller 16, an intermediate transfer belt cleaning unit 17, four image forming units 18Y, 18M, 18C, and 18K, an optical writing unit 21, and a fixing unit 25.

The intermediate transfer belt 13 serving as an intermediate transfer member for an intermediate transfer unit 29 of the image forming apparatus 1 is disposed at a substantially center of the main body 100. The intermediate transfer belt 13 is spanned around the first, second, and third supporting rollers 14, 15, and 16 and rotates or travels in a closed loop in a clockwise direction in FIG. 1.

In the image forming apparatus 1 in FIG. 1, the third supporting roller 16 serves as a drive roller of the intermediate transfer belt 13.

The intermediate transfer belt cleaning unit 17 is disposed at a left side of the second supporting roller 15 in FIG. 1. The intermediate transfer belt cleaning unit 17 removes residual toner remaining on a surface of the intermediate transfer belt 13 after an image transfer operation has been completed.

The four image forming units 18Y, 18M, 18C, and 18K are disposed above the surface of the intermediate transfer belt 13 ranging between the first supporting roller 14 and the second supporting roller 15. The four image forming units 18Y, 18M, 18C, and 18K have similar structures and functions, except that the toners are different colors to form yellow images, magenta images, cyan images, and black images, respectively, along a travel direction of the intermediate transfer belt 13. The image forming units 18Y, 18M, 18C, and 18K are separately arranged at positions having horizontal heights or elevations forming a tandem-type image forming section 20.

The image forming units 18Y, 18M, 18C, and 18K includes respective photoconductor drums 40Y, 40M, 40C, and 40K, respectively. Around each of the photoconductor drums 40Y, 40M, 40C, and 40K, a charging unit, a developing unit, and a cleaning unit are disposed in the corresponding one of the image forming units 18Y, 18M, 18C, and 18K.

The image forming units 18Y, 18M, 18C, and 18K further include primary transfer units 62Y, 62M, 62C, and 62K, respectively. The primary transfer units 62Y, 62M, 62C, and 62K are disposed opposite the photoconductor drums 40Y, 40M, 40C, and 40K, respectively, with the intermediate transfer belt 13 therebetween.

The optical writing unit 21 is disposed above the tandem-type image forming section 20. The optical writing unit 21 emits respective laser light beams separately to the photoconductor drums 40Y, 40M, 40C, and 40K, so that electrostatic latent images are formed on respective surfaces of the photoconductor drums 40Y, 40M, 40C, and 40K.

A secondary transfer unit 22 is located on the opposite side of the intermediate transfer belt 13 from the tandem-type image forming section 20. The secondary transfer unit 22 includes a secondary transfer belt 24. The secondary transfer belt 24 is formed in a closed loop and is extended between two secondary transfer rollers 23*a* and 23*b*. The secondary transfer unit 22 is arranged such that a portion of the secondary transfer belt 24, which is close to the secondary transfer roller 23*b*, presses the intermediate transfer belt 13 against the third supporting roller 16. When a recording sheet is conveyed to a portion between the supporting roller 16 and the secondary transfer roller 23*b* of the secondary transfer belt 24, an overlaid color toner image formed on the surface of the intermediate transfer belt 13 is transferred onto the recording sheet. At a lower left side of the main body 100, in a vicinity of the secondary transfer roller 23*a* and below the second supporting roller 15, the fixing unit 25 is positioned. Detailed structure and functions of the fixing unit 25 will be described later.

The secondary transfer unit 22 also serves as a sheet conveyance mechanism for conveying a recording sheet having a color toner image thereon to the fixing unit 25. As an alternative to the secondary transfer unit 22, a transfer roller or a non-contact-type transfer charging unit may be used. However, in a case in which the transfer roller or the non-contact-type transfer charging unit is used, it is preferable to separately provide a sheet conveyance mechanism for conveying a recording sheet having a color toner image thereon to the fixing unit 25.

The fixing unit 25 includes a fixing roller 26 and a pressure roller 27, and is configured to press the pressure roller 27 against the fixing roller 26. The fixing roller 26 includes a heating element therein to be heated to an appropriate temperature when fixing a color toner image onto a recording sheet by application heat and pressure.

In the image forming apparatus 1 shown in FIG. 1, the main body 100 further includes a sheet reverse unit 28 for reversing a recording sheet on one side of which an image is formed so that another image can be formed on the other side of the recording sheet for a duplex image forming operation in a duplex copy mode. The sheet reverse unit 28 is disposed below the secondary transfer unit 22 and the fixing unit 25 and is substantially parallel to the tandem-type image forming section 20.

While the main body 100 includes several components, such as a sheet transporting passage 48 and a pair of registration rollers 49 serving as the sheet feeding mechanism, which will be described below, the sheet feeding mechanism is mainly arranged in the sheet feeding table 200.

The sheet feeding table 200 serves as the sheet feeding mechanism and is arranged in a lower portion of the image forming apparatus 1. The sheet feeding table 200 includes sheet feeding rollers 42*a*, 42*b*, and 42*c*, a sheet bank 43, sheet feeding cassettes 44*a*, 44*b*, and 44*c*, sheet separation rollers 45*a*, 45*b*, and 45*c*, a sheet transporting passage 46, and multiple sheet feeding rollers 47.

The sheet feeding cassettes 44*a*, 44*b* and 44*c* are provided to the sheet bank 43 and are loaded with a stack of sheets of particular size, including a recording sheet (not shown). When an image forming operation is performed, the recording sheet is fed from one of the sheet feeding cassettes 44*a*, 44*b*, and 44*c* and is conveyed toward the pair of registration rollers 49.

The sheet feeding table 200 also includes a manual sheet feeding tray 51, a switching pawl 55, a pair of sheet discharging rollers 56, and a sheet discharging tray 57.

The manual sheet feeding tray 51 is mounted on the right side of the main body 100 of FIG. 1, and includes sheet inlet rollers 50, a pair of sheet separation rollers 52 and a manual sheet transporting passage 53. After opening the manual sheet feeding tray 51, an operator of the image forming apparatus 1000 may feed sheets by hand.

The image scanner 300 includes an original document stacker 30 and a contact glass 32.

The image scanner 300 also includes first and second moving units 33 and 34, an image forming lens 35, and an image reading sensor 36.

As previously described, FIG. 1 shows the image forming apparatus 1 with the intermediate transfer belt system. However, the present patent application can apply to an image forming apparatus with an intermediate transfer drum system. When an image forming apparatus with an intermediate transfer drum system is employed, the supporting rollers 14, 15, and 16 can be removed and the image forming units 18Y, 18M, 18C, and 18K may be arranged around the intermediate transfer drum, instead of being arranged in a horizontal manner.

Now, a full color image forming operation of the above-described image forming apparatus 1 is described.

Before starting an image forming operation, a set of original documents is placed on the original document stacker 30 of the ADF 400. Alternatively, the set of original documents can manually be placed sheet by sheet directly on the contact glass 32 of the image scanner 300. When each original document is directly placed on the contact glass 32, an operator lifts up the ADF 400 having a shell-like openable structure. After the original document is correctly placed, the operator lowers the ADF 400 to a closing position, therefore an entire surface of the original document placed on the contact glass 3 may be pressed by a lower surface of the ADF 400.

When a start button, not shown, is pressed, an uppermost sheet of the set of original documents placed on the ADF 400 is separated and is transported to the contact glass 32 of the image scanner 300 and, subsequently, the image scanner 300 is activated. That is, the first and second moving units 33 and 34 of the image scanner 300 slide in a predetermined direction. When the original document is manually set on the contact glass 32, the image scanner 300 is immediately activated upon the press of the start button.

The first moving unit 33 causes a light beam to emit and deflects the light beam reflected by the original document placed on the contact glass 32. The second moving unit 34 receives the light beam reflected by the mirror or the first moving unit 33 and reflects the light beam to the image reading sensor 36 via the image forming lens 35.

When the start button is pressed, the third supporting roller 16 serving as a drive roller is driven by a drive motor, not shown, to rotate the other two rollers, which are the first and second supporting rollers 14 and 15. This causes the intermediate transfer belt 13 to rotate. Subsequently, the image forming units 18Y, 18M, 18C, and 18K are driven to rotate the corresponding photoconductor drums 40Y, 40M, 40C, and 40K. This forms single color images in yellow, magenta, cyan, and black on the respective photoconductor drums 40Y, 40M, 40C, and 40K of the image forming units 18Y, 18M, 18C, and 18K in the image forming section 20.

When the image forming apparatus 1 receives full color image data, each of the photoconductor drums 40Y, 40M, 40C, and 40K rotates in a counterclockwise direction as indicated by respective arrows in FIG. 1 and are uniformly charged by corresponding charging units, not shown. The optical writing unit 21 emits the light beams corresponding to the respective color image data and irradiates the photoconductor drums 40Y, 40M, 40C, and 40K of the image forming units 18Y, 18M, 18C, and 18K, respectively. Electrostatic latent images corresponding to the respective color image data are formed on respective surfaces of the photoconductor drums 40Y, 40M, 40C, and 40K. The electrostatic latent images formed on the respective photoconductor drums 40Y, 40M, 40C, and 40K are developed by respective developing units, not shown, which contain respective color toners therein, into yellow, magenta, cyan, and black toner images, respectively. Those color toner images are sequentially overlaid on the surface of the intermediate transfer belt 13 so that a composite or overlaid color image can be formed on the surface of the intermediate transfer belt 13.

When the start button is pressed, the original document is scanned and a size of a copy sheet is determined. For example, a size of the copy sheet selected is equivalent to the recording sheet accommodated in the sheet feeding cassette 44*a*, the sheet feeding roller 42*a* starts to rotate so that the recording sheet is conveyed to the sheet separation roller 45*a* in the sheet feeding cassette 44*a*. The sheet separation roller 45*a* separates the recording sheet from the following sheets and transfers the recording sheet to the sheet transporting passage 46. The recording sheet is conveyed by the multiple sheet feeding rollers 47 through the sheet transporting passage 48 to the pair of registration rollers 49.

When manual insertion is used, the sheet inlet roller 50 is rotated to feed a set of recording sheets placed on the manual sheet feeding tray 51 to the pair of sheet separation rollers 52. Then, the pair of sheet separation rollers 52 separate an uppermost recording sheet from the other recording sheets of the set of recording sheets placed on the manual sheet feeding tray 51 and conveys the uppermost recording sheet, which will be referred to as the recording sheet, to the pair of registration rollers 49 through the manual sheet transporting passage 53.

Then, the pair of registration rollers 49 stops and feeds the recording sheet in synchronization with a movement of the composite color image towards a transfer area formed between the intermediate transfer belt 13 and the secondary transfer unit 22. In particular, the transfer area is formed between a portion where the intermediate transfer belt 13 is supported by the third supporting roller 16 and a portion where the secondary transfer unit 22 is supported by the secondary transfer roller 23*b*. The composite color image formed on the surface of the intermediate transfer belt 13 is transferred onto the recording sheet at the transfer area.

The recording sheet having the composite color image thereon is further conveyed by the secondary transfer belt 24 and passes through the fixing unit 25. The fixing unit 25 fixes the composite color image to the recording sheet by applying heat and pressure.

As an alternative, the recording sheet may be sent to the sheet reverse unit 28 when the switching pawl 55 selects a sheet conveyor passage, not shown, for the duplex image forming operation. When the duplex image forming operation is performed, the sheet reverse unit 28 receives the recording sheet, which on one side an image is formed. Another recording sheet is fed to the sheet reverse unit 28 after the recording sheet is switched back at the sheet reverse unit 28. The sheet reverse unit 28 then conveys the recording sheet via the sheet conveyor passage 48 to the pair of registration rollers 49 to pass through the transfer area formed between the intermediate transfer belt 13 and the secondary image transfer unit 22 so that a next composite color image is transferred onto the back surface of the recording sheet. Then, the recording sheet, having composite color images printed on the front and back sides, is conveyed to the fixing unit 25.

After the recording sheet passes through the fixing unit 25, the recording sheet passes through a discharging passage selected by the switching pawl 55 and is discharged to the sheet discharging tray 57 via the pair of sheet discharging rollers 56.

After the composite color image is transferred onto the recording sheet, the intermediate transfer belt cleaning unit 17 removes residual toner on the surface of the intermediate transfer belt 13 before a next image forming operation performed in the tandem-type image forming section 20.

The pair of registration rollers 49 of the image forming apparatus 1 of FIG. 1 is generally grounded. However, a bias can be applied to the pair of registration rollers 49 to remove paper dust and/or other materials from the surface of the recording sheet.

Next, the image forming operation for producing black and white copies is described.

When the image forming apparatus 1 receives a command to produce black and white copies according to black and white image data, the second supporting roller 15 is moved in a downward direction, thereby separating the image transfer belt 13 from the photoconductor drums 40Y, 40M, and 40C. The driving operation for the photoconductor drums 40Y, 40M, and 40C are temporarily stopped. The photoconductor drum 40K of the image forming unit 18K rotates in the counterclockwise direction in FIG. 1 to be uniformly charged with the corresponding charging roller, not shown. Then an image-wise laser light beam corresponding to the black and white image data irradiates the photoconductor drum 40K to form an electrostatic latent image on the photoconductor drum 40K. The electrostatic latent image formed on a surface of the photoconductor drum 40K is developed with a black developing unit, not shown, resulting in formation of a black toner image on the photoconductor drum 40K. In this case, the image forming units 18Y, 18M and 18C, the photoconductor drums 40Y 40M, and 40C, and developing units, not shown, corresponding to the photoconductor drums 40Y 40M, and 40C are not activated. Therefore, undesired abrasion of the photoconductor drums 40Y, 40M, and 40C and undesired consumption of the toners other than the black toner can be prevented.

Figure 2:
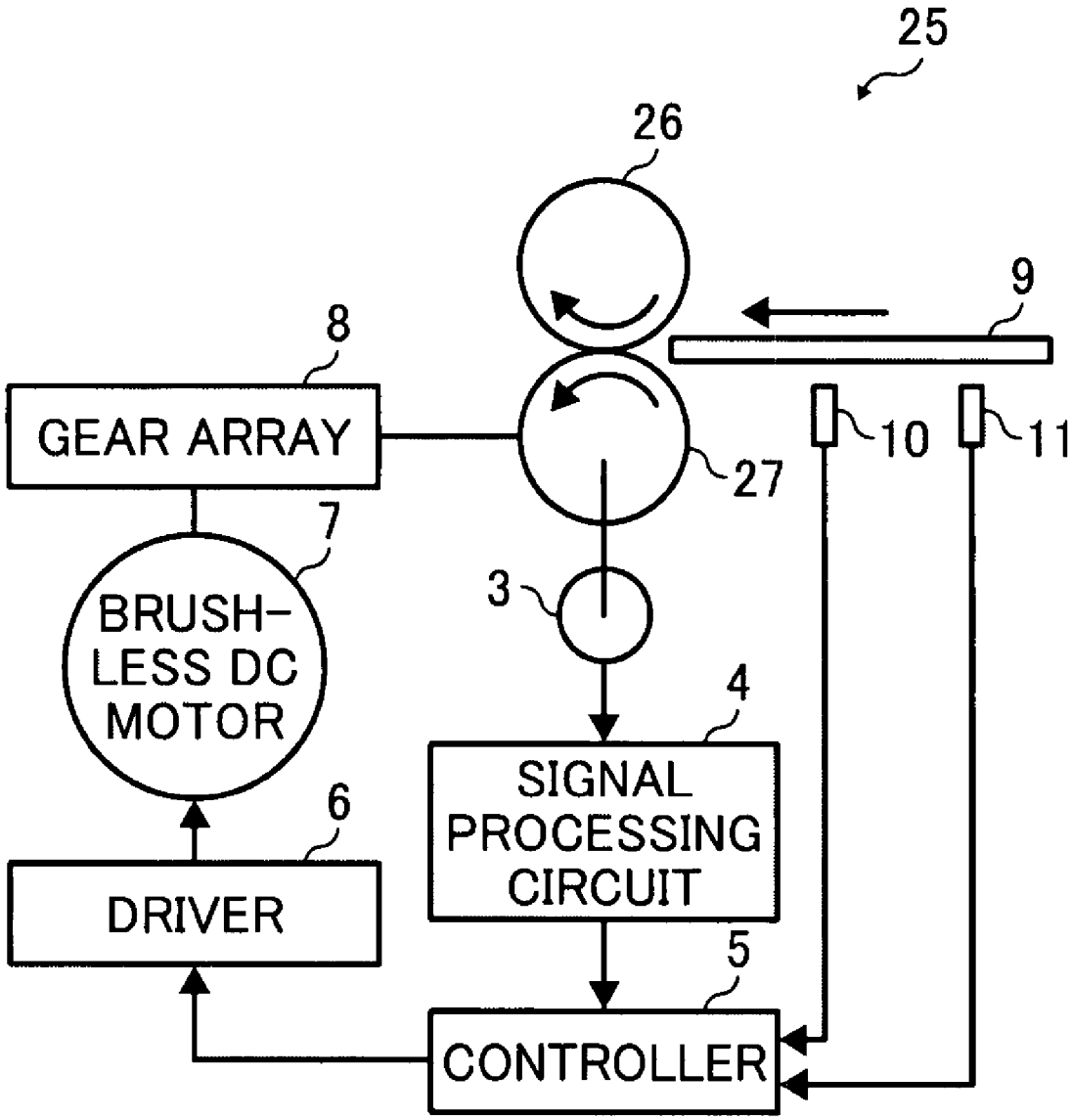
FIG. 2 is a block diagram of one example of a sheet conveying device, according to an example embodiment of the present patent application, of the image forming apparatus of FIG. 1.

Referring to FIG. 2, a block diagram of the fixing unit 25 is described. In FIG. 2, the fixing unit 25 serves as a sheet conveying device.

In FIG. 2, the fixing unit 25 includes an encoder 3, a signal processing circuit 4, a controller 5, a driver 6, a brushless DC motor 7, a gear array 8, a sheet detection unit 10, and a thickness detection unit 11.

In the fixing unit 25, the fixing roller 26 and the pressure roller 27 are disposed in contact with each other, and a recording sheet 9, which is a sheet-type recording medium, passes therebetween.

The pressure roller 27 receives a driving force from the brushless DC motor 7 via the gear array 8 to rotate.

The gear array 8 serves as a transmitter. As an alternative to the gear array 8, a drive transmission mechanism including synchronous belt and/or synchronous pulleys can be applied to the present patent application.

The encoder 3 and the signal processing circuit 4 detect a rotation speed of the pressure roller 27. Specifically, the encoder 3 detects an angular velocity of the pressure roller 27, and the signal processing circuit 4 converts angular data of the pressure roller 27 obtained by the encoder 3 to speed data of the pressure roller 27 or drive roller speed data. The detection results are transmitted to the controller 5.

The sheet detection unit 10 and the thickness detection unit 11 are disposed along a conveying path of the recording sheet 9.

The sheet detection unit 10 detects whether or not the recording sheet 9 is conveyed, and a detection signal thereof is transmitted to the controller 5.

The thickness detection unit 11 detects a thickness of the recording sheet 9, and a detection signal thereof is transmitted to the controller 5.

As the sheet detection unit 10, an optical sensor including a light emitting part and a light receiving part is generally used. However, the sheet detection unit 10 of the present patent application is not limited to an optical sensor, but can be a unit or element having a different structure or system as long as the unit or element can be provided in the image forming apparatus 1.

It is preferable that the sheet detection unit 10 is disposed in the vicinity of or close as possible to a nip contact, which is a contact portion where the fixing roller 26 and the pressure roller 27 contact to each other. By so doing, variations in estimated time of the recording sheet 9 entering the nip contact between the fixing roller 26 and the pressure roller 27, which are caused by variations in conveying speed of a sheet-type recording medium, can be reduced as much as possible.

Regarding the thickness detection unit 11, a light transmission method and a displacement detection method are widely used. The present patent application can employ a unit or element using any detection method as long the unit or element can be provided in the image forming apparatus 1. In addition, the thickness detection unit 11 can be disposed at a different position in the fixing unit 25 at an upstream side in a travel direction of a sheet-type recording medium.

The controller 5 receives the drive roller speed data of the pressure roller 27 and the recording sheet data of the recording sheet 9 transmitted by the sheet detection unit 10 and by the thickness detection unit 11. Based on the above-described data, the controller 5 transmits a control instruction value to the driver 6 to drive the brushless DC motor 7.

The driving force of the brushless DC motor 7 is transmitted via the gear array 8 or other drive transmission mechanism to control the pressure roller 27 serving as a drive roller of the fixing unit 25.

As previously described, the fixing unit 25 serves as a sheet conveying device according to an example embodiment of the present patent application. The fixing unit 25 includes the brushless DC motor 7 serving as a drive source, the pressure roller 27 serving as a drive roller driven by the brushless DC motor 7, the fixing roller 26 serving as a driven roller contacting with pressure and rotating with the pressure roller 27, the encoder 3 serving as an angular velocity detector to detect the angular velocity of the pressure roller 27, the controller 5 controls the brushless DC motor 7 based on the detection results of the encoder 3, and the sheet detection unit 10 serving as a timing estimation unit to estimate a timing of the recording sheet 9 entering the nip contact between the pressure roller 27 and the fixing roller 26.

In this example embodiment, the fixing unit 25 of the image forming apparatus 1 includes a configuration employing a roller fixing method. However, the fixing unit 25 of the image forming apparatus 1 can include a configuration employing a belt fixing method. The fixing unit 25 with the belt fixing method can serve as a sheet conveying device and be applied to the present patent application by making the configuration similar to the following configuration of the intermediate transfer unit 29 employing an intermediate transfer belt method.

Figure 3:
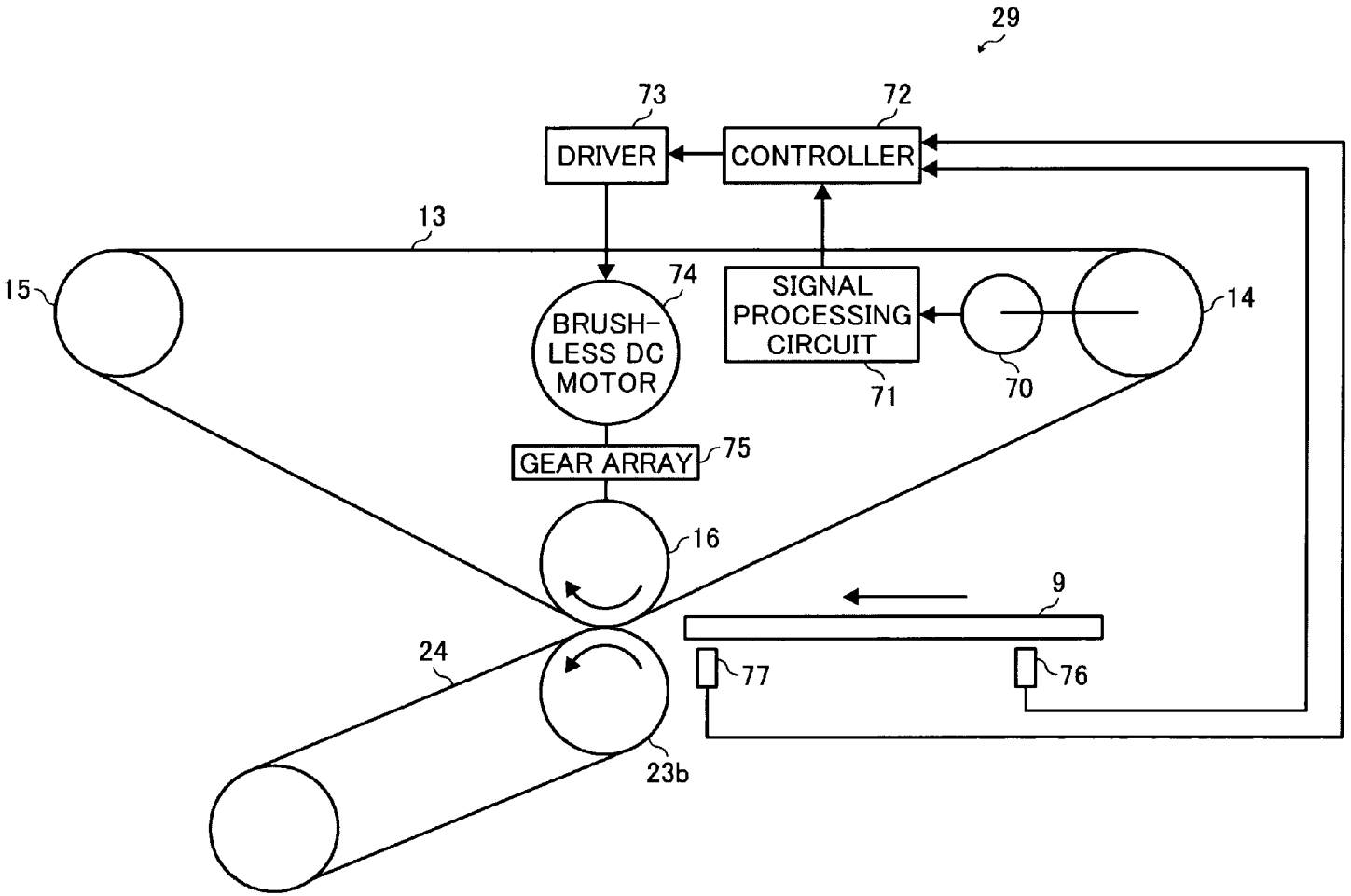
FIG. 3 is a block diagram of another example of a sheet conveying device, according to an example embodiment of the present patent application.

Referring to FIG. 3, a block diagram of the intermediate transfer unit 29 is described. In FIG. 3, the intermediate transfer unit 25 serves as a sheet conveying device.

As previously described, the intermediate transfer unit 29 of the image forming apparatus 1 of FIG. 1 includes the intermediate transfer belt 13 and the secondary transfer unit 22. The intermediate transfer belt 13 formed in a closed loop is spanned around the first and second supporting rollers 14 and 15 and the third supporting roller 16 serving as a drive roller of the intermediate transfer belt 13. The secondary transfer unit 22 employing a belt method includes the secondary transfer belt 24 that is formed in a closed loop and is spanned around the two secondary transfer rollers 23*a* and 23*b*.

Alternatively, the secondary transfer unit 22 can employ a roller method. In this case, a secondary transfer roller 23 can be used instead of the secondary transfer belt 24 and the two secondary transfer rollers 23*a* and 23*b*.

The intermediate transfer unit 29 of FIG. 3 includes an encoder 70 corresponding to the encoder 3 of the fixing unit 25, a signal processing circuit 71 corresponding to the signal processing circuit 4 of the fixing unit 25, a controller 72 corresponding to the controller 5 of the fixing unit 25, a driver 73 corresponding to the driver 6 of the fixing unit 25, a brushless DC motor 74 corresponding to the brushless DC motor 7 of the fixing unit 25, a gear array 75 corresponding to the gear array 8 of the fixing unit 25, a sheet detection unit 76 corresponding to the sheet detection unit 10 of the fixing unit 25, and a thickness detection unit 77 corresponding to the thickness detection unit 11 of the fixing unit 25. The structures and functions of the above-described elements of the intermediate transfer unit 29 of FIG. 3 are same as the structures and functions of the elements provided to the above-described fixing unit 25 of FIG. 2. Therefore, detailed descriptions are omitted.

In the configuration of the intermediate transfer unit 29 according to this example embodiment of the present patent application, the encoder 70 is mounted on the first supporting roller 14 to detect the speed of the intermediate transfer belt 13 based on the rotation speed of the first supporting roller 14. As an alternative to the first supporting roller 14, the encoder 70 can be mounted on the third supporting roller 16 serving as a drive roller to detect the speed of the intermediate transfer belt 13. Alternatively, a laser Doppler velocimeter can be used to directly detect the speed of the intermediate transfer belt 13.

In this example embodiment, the intermediate transfer unit 29 of the image forming apparatus 1 includes a configuration employing an intermediate transfer belt method. However, the intermediate transfer unit 29 of the image forming apparatus 1 can include a configuration employing an intermediate transfer roller method alternative to the intermediate transfer belt method. The intermediate transfer unit 29 with the intermediate transfer roller method can serve as a sheet conveying device and be applied to the present patent application by making the configuration similar to the configuration of the fixing unit 25 employing a roller fixing method.

Figure 4:
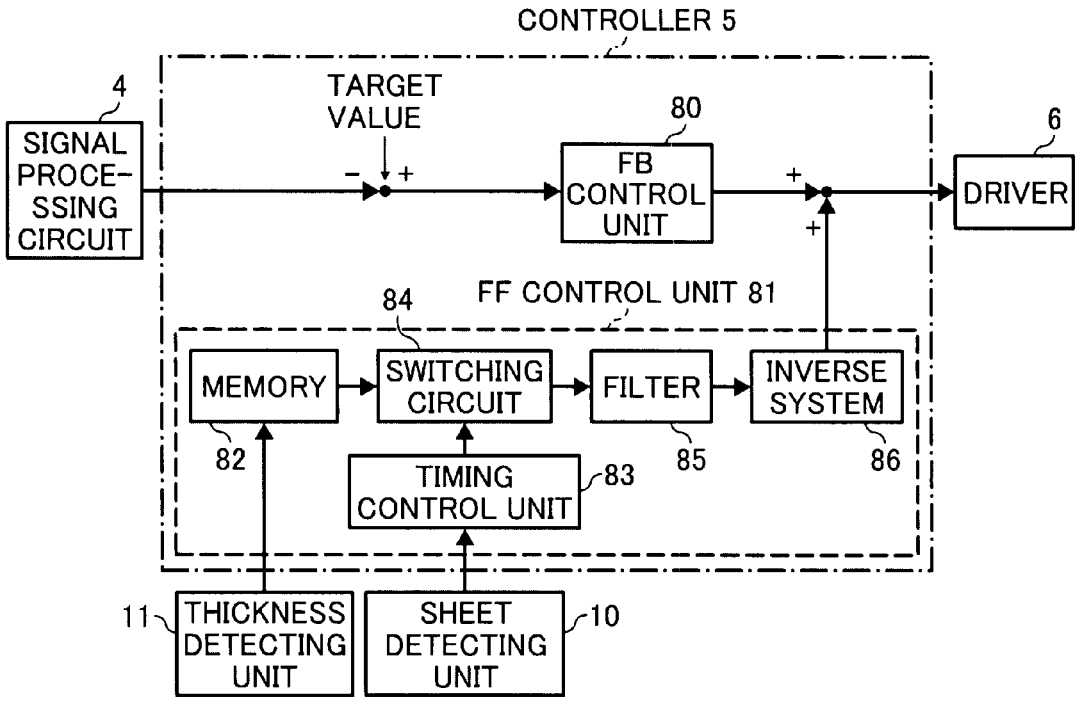
FIG. 4 is a block diagram of a controller included in the sheet conveying device of FIG. 2.

Referring to FIG. 4, a block diagram of the controller 5 is described.

It is noted that reference numerals of FIG. 4 are described with the reference numerals corresponding to the units of the fixing unit 25 of FIG. 2 and these reference numerals can mean the reference numerals corresponding to the units of the intermediate transfer unit 29 of FIG. 3. For example, the reference numeral "4" in FIG. 4 corresponds to the signal processing circuit 4 of FIG. 2 and the signal processing unit 71 of FIG. 3, the reference numeral "5" in FIG. 4 corresponds to the controller 5 of FIG. 2 and the controller 72 of FIG. 3, the reference numeral "6" in FIG. 4 corresponds to the driver 6 of FIG. 2 and the driver 73 of FIG. 3, the reference numeral "10" in FIG. 4 corresponds to the sheet detecting unit 10 of FIG. 2 and the sheet detecting unit 76 of FIG. 3, and the reference numeral "11" in FIG. 4 corresponds to the thickness detecting unit 11 of FIG. 2 and the thickness detecting unit 77 of FIG. 3. The same relation as described above may be applied to the following drawings.

The controller 5 mainly includes a feedback control unit 80 and a feed-forward control unit 81.

The feedback control unit 80 includes a general feedback control system to reduce deviation between the drive roller speed data obtained according to the encoder 3 and the signal processing circuit 4 and a target value, and is designed to stably drive the drive roller 16 at a speed of a target value. For example, the feedback control unit 80 may include a known proportional-integral-derivative (PID) controller. However, the feedback control unit 80 applied to the present patent application is not limited to the PID controller and can include a different controller.

The feed-forward control unit 81 includes a memory 82, a timing control unit 83, a switching circuit 84, a filter 85, and an inverse system 86.

The memory 82 stores feed-forward target values corresponding to multiple thicknesses of various recording sheets. According to the thickness of the recording sheet 9 detected by the thickness detection unit 11, a feed-forward target value is optimized to be provided or output from the memory 82.

For example, the memory 82 may store feed-forward target values of respective thicknesses corresponding to recording sheets having 220 kg, 180 kg, 140 kg, and 100 kg in a unit of ream weight. When the thickness detection unit 11 detects the thickness of the recording sheet 9, a feed-forward target value of the most closely approximate thickness is output according to the detected thickness of the recording sheet 9. For conducting a more precise control with respect to the thickness of the recording sheet 9, feed-forward target values subdivided in a further detailed steps may need to be stored in the memory 82. In a case in which the control is conducted with respect to two different types of recording sheets, such as regular paper and thick paper, the memory 82 may store two types of feed-forward target values corresponding to typical papers having different thicknesses.

Figure 5:
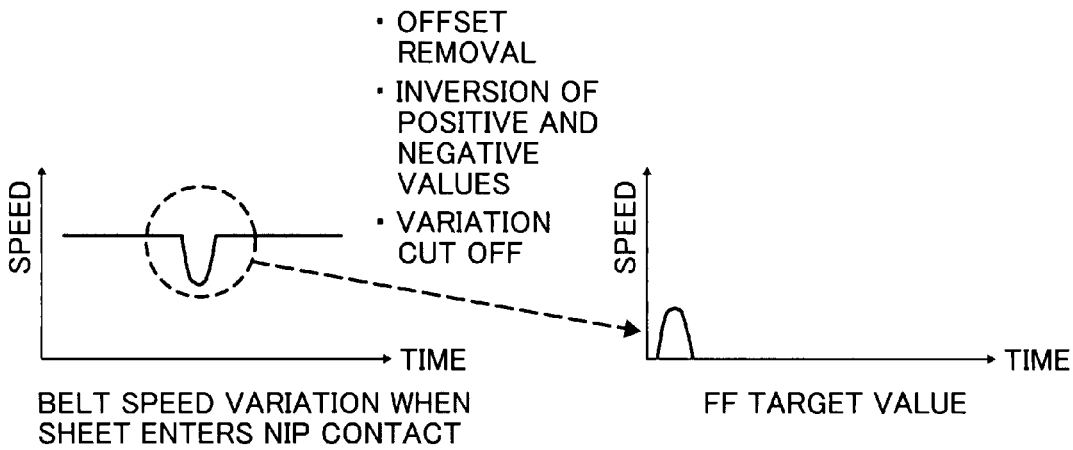
FIG. 5 is an illustration of a feed-forward target value stored in a memory of the controller of FIG. 4.

Referring to FIG. 5, a description is given of feed-forward target values stored in the memory 82.

In the controller 5, the feed-forward target value can be obtained by conducting a signal processing with respect to data on variations in speed of the pressure roller 27, serving as a drive roller, detected by the encoder 3 and the signal processing circuit 4 at a timing that the recording sheet 9 enters the nip contact. Specifically, the signal processing includes processes of removing offset from the detected speed variation data, inversing positive and negative values, and cutting off a part including the speed variation. The signal processing circuit 4, which is located outside the controller 5, can conduct the above-described signal processing in advance with respect to different recording sheets 9 having various thicknesses, and the memory 82 can store the results of the above-described signal processing as the feed-forward target values.

At a specific delay timing after receiving a sheet detection signal from the sheet detection unit 10, the timing control unit 83 turns on the switching circuit 84. The specific delay timing ranges from the receipt of the sheet detection signal, which is a moment that the sheet detection unit 10 detects the recording sheet 9, to a timing that the recording sheet 9 enters the nip contact between the drive roller and the driven roller. The specific delay timing can be set in advance by calculating according to the specification and/or design of the image forming apparatus 1.

When the switching circuit 84 turns on, the memory 82 outputs an appropriate feed-forward target value, which is then transmitted to the filter 85.

The filter 85 includes a low-pass filter that may remove high-pass noise, reduce a gain of a high-pass resonance frequency, and correct a transfer function of the inverse system 86 to a proper value. A cutoff frequency of the filter 85 may be set to a value equal to or greater than the maximum value of a frequency component of the feed-forward target value.

The feed-forward target value passed through the filter 85 is transmitted to the inverse system 86.

The inverse system 86 obtains transfer characteristics from the input values to the driver 6 to the speed of the pressure roller 27 in the fixing unit 25 or from the input values to the driver 73 to the speed of the intermediate transfer belt 13 in the intermediate transfer unit 29, through modeling or measurement. The inverse system 86 includes inverse functions of the transfer functions of the transfer characteristics. Accordingly, the inverse system 86 converts the feed-forward target value to an input value to the driver 6.

The driver input value obtained by the feed-forward control unit 81 based on the feed-forward target value is added to a driver input value by the feedback control unit 80, and the added driver input value is transmitted to the driver 6.

When the image forming apparatus 1 has a thick paper selection mode, it is preferable to arrange such that the image forming apparatus 1 performs the feed-forward control only when the thick paper selection mode is selected. With the above-described arrangement, a more effective control can be achieved for the image forming apparatus 1.

Figure 6:
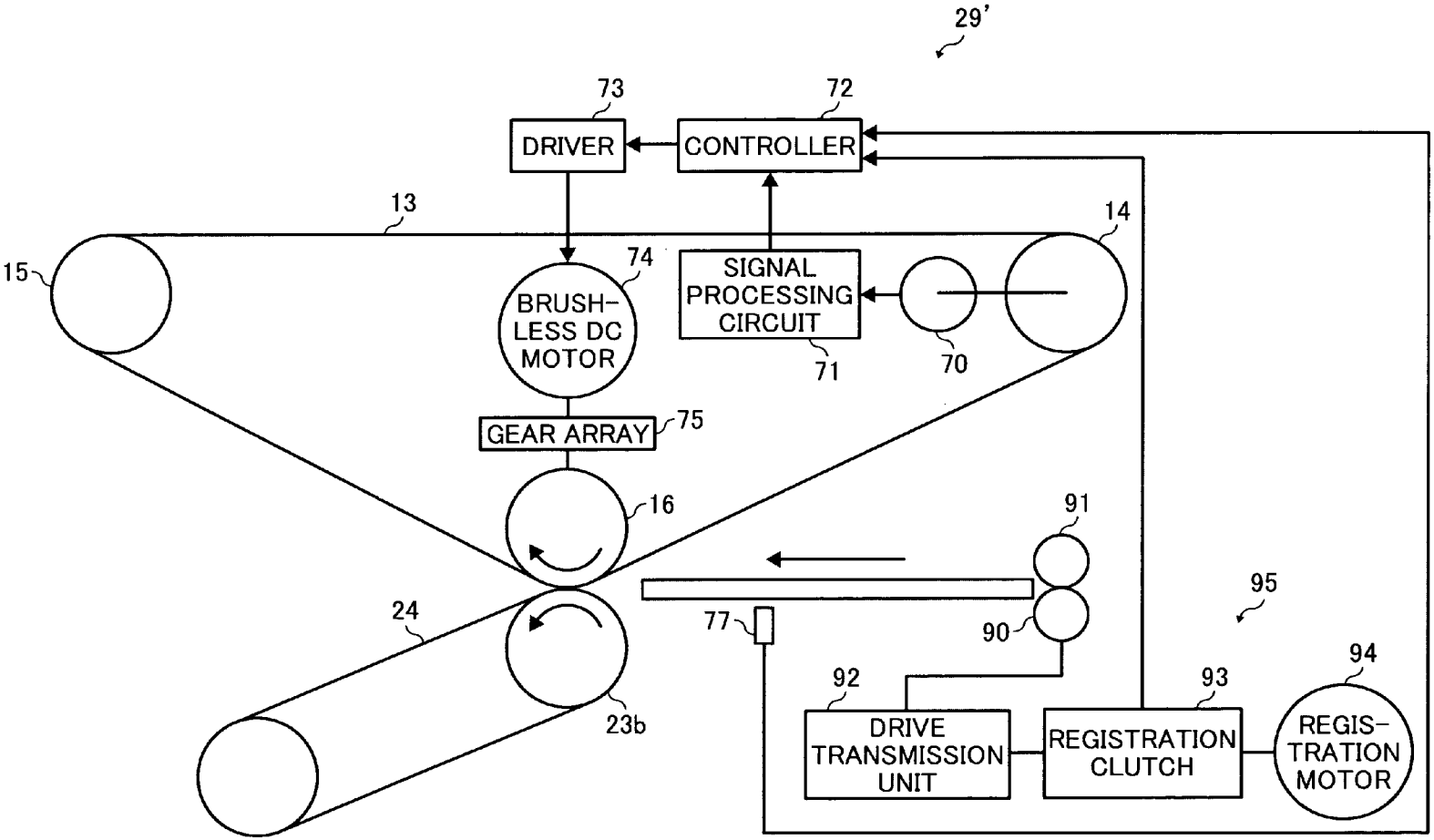
FIG. 6 is a block diagram of another example of a sheet conveying device according to an example embodiment of the present patent application.

Referring to FIG. 6, a block diagram of an intermediate transfer unit 29' serving as a sheet conveying device according to another example embodiment of the present patent application is described.

The configuration of the intermediate transfer unit 29' of FIG. 6 is similar to the configuration of the intermediate transfer unit 29 of FIG. 3. Except that, while the intermediate transfer unit 29 of FIG. 3 includes the sheet detection unit 76 as an optical sensor, the intermediate transfer unit 29' of FIG. 6 is provided with a registration unit 95.

The registration unit 95 is provided at an upstream side in the sheet conveying device in the sheet travel direction. The registration unit 95 uses an actuating signal transmitted therefrom to detect the recording sheet 9. With the above-described configuration, cost reduction can effectively be achieved compared with the configuration provided with optical sensors as the sheet detection unit 76.

The registration unit 95 includes a registration roller 90, a registration facing roller 91, a drive transmission unit 92, a registration clutch 93, and a registration motor 94.

The registration roller 90 and the registration facing roller 91 form the pair of registration rollers 49 shown in FIG. 1.

Regarding the actuating signal to detect the recording sheet 9, it is preferable to employ an ON signal output by the registration clutch 93. When the registration clutch 93 is not provided to the registration unit 95, it is preferable to use an ON signal output by the registration motor 94.

Figure 7:
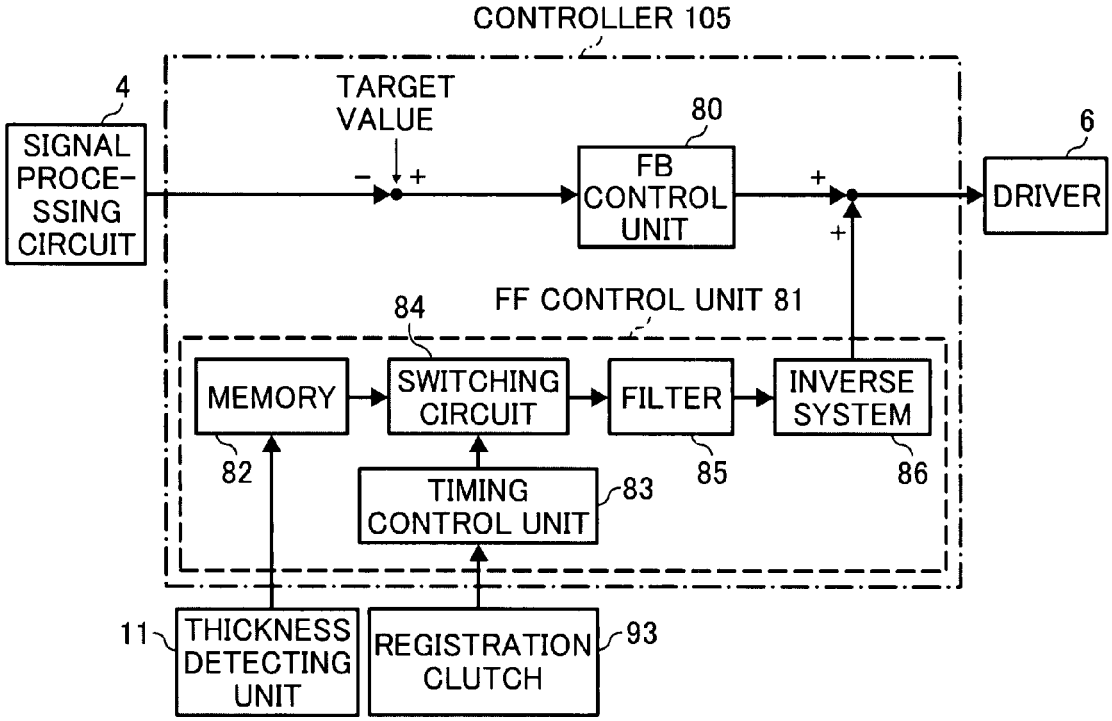
FIG. 7 is a block diagram of a controller included in the sheet conveying device of FIG. 6.

Referring to FIG. 7, a block diagram of a controller 105 controlling the sheet conveying device or the intermediate transfer unit 29' of FIG. 6 is described.

The configuration and functions of the controller 105 is basically same as the controller 5 of FIG. 4, except that the controller 105 is connected to the registration clutch 93 instead of the sheet detection unit 10 provided in the controller 5 of FIG. 4. In addition, the specific delay timing set in the timing control unit 83 is adjusted to comply with the configuration of the intermediate transfer unit 29'.

In this example embodiment, the controller 5 corresponds to the configuration of the sheet conveying device employing the intermediate transfer belt 13. However, the controller 5 shown in FIG. 7 is applicable to the configuration of a sheet conveying device employing an intermediate transfer drum. Further, the controller 5 can be applied to a configuration of a fixing unit serving as a sheet conveying device.

Figure 8:
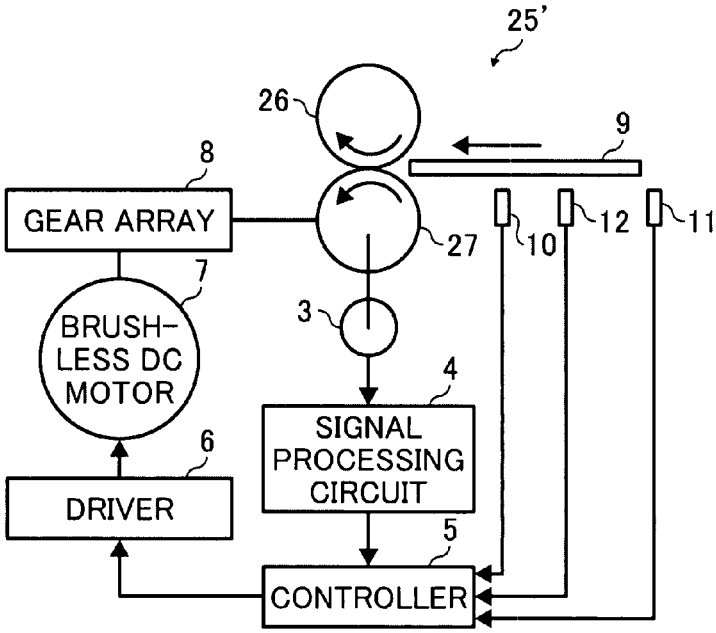
FIG. 8 is a block diagram of another example of a sheet conveying device according to an example embodiment of the present patent application.
Figure 9:
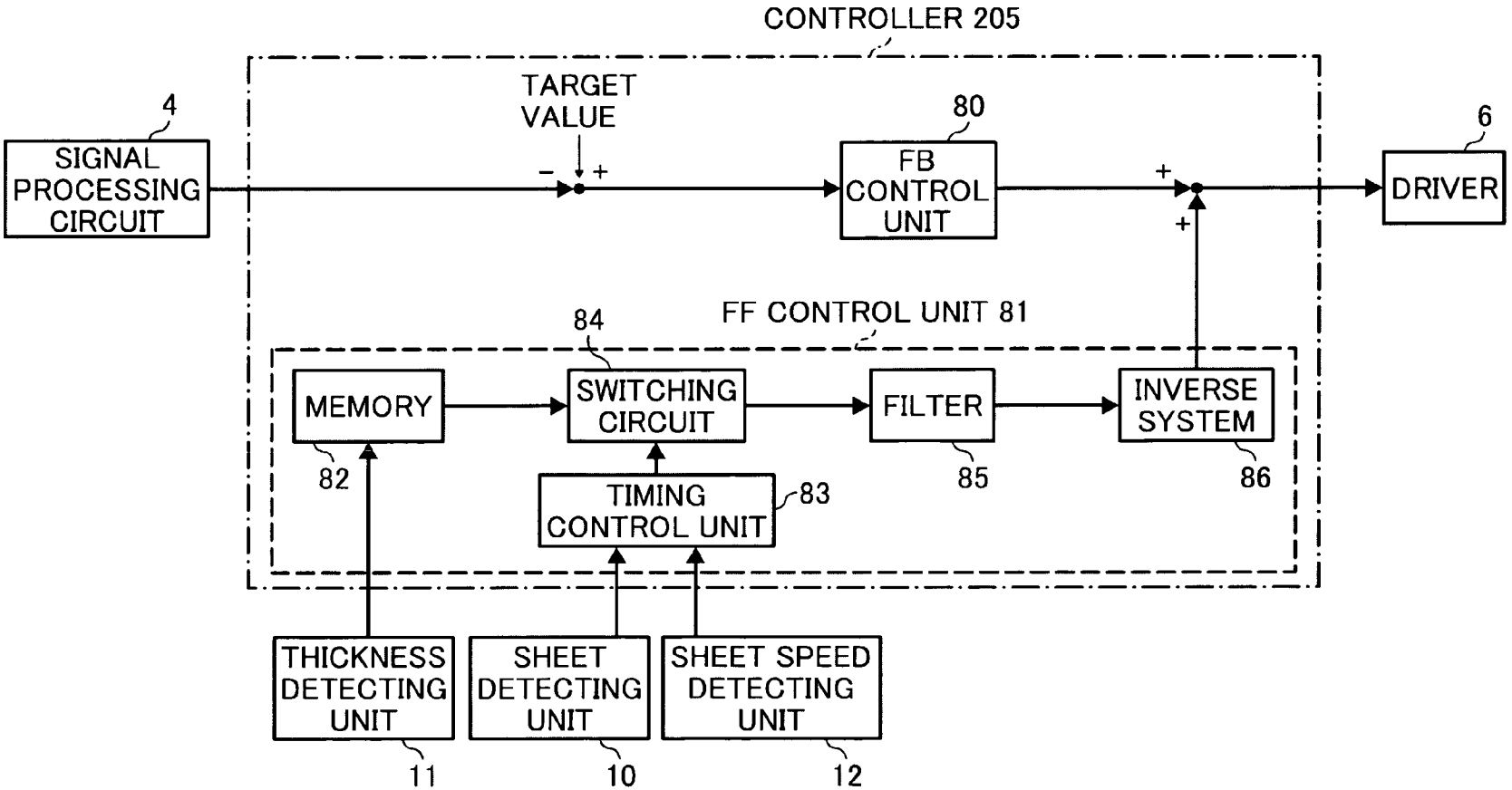
FIG. 9 is a block diagram of a controller included in the sheet conveying device of FIG. 8.

Referring to FIGS. 8 and 9, block diagrams of a fixing unit 25' serving as a sheet conveying device according to another example embodiment of the present patent application are described.

Different from the previously described configurations of the sheet conveying devices of FIGS. 2, 3, and 6, the sheet conveying device shown in FIGS. 8 and 9 further includes a sheet speed detection unit 12.

The sheet speed detection unit 12 is effectively used when a timing is detected in a more accurate manner and/or when variations in conveyance speed of the recording sheet 9 are greater. The sheet speed detection unit 12 may conduct a direct method in which a speed of a recording sheet is directly detected, such as a laser Doppler velocimeter, or an indirect method in which an optical sensor detects a passage timing of a recording sheet between given two points. However, the sheet speed detection unit 12 of the present patent application is not limited to the above-described unit, but can be a unit having a different method as long as the unit can be provided in the image forming apparatus 1. An estimated time of a recording sheet entering the nip contact between the fixing roller 26 and the pressure roller 27 is calculated based on the drive roller speed data obtained by the sheet speed detection unit 12. Therefore, a calculation time may need to be accounted for. Accordingly, a distance between the sheet detection unit 10 and the sheet speed detection unit 12 may need to sufficiently be secured.

The block diagram of FIG. 9 shows a configuration of a controller 205 controlling the sheet conveying unit as the fixing unit 25' of FIG. 8.

The configuration and functions of the controller 205 is basically same as the controller 5 of FIG. 4 and the controller 105 of FIG. 7, except that the controller 205 shown in FIG. 9 is further connected to the sheet speed detection unit 12.

When the sheet speed detection unit 12 detects the speed of the recording sheet 9, the controller 205 shown in FIG. 9 causes the timing control unit 83 to calculates a period of time until the recording sheet 9 enters the nip contact between the fixing roller 26 and the pressure roller 27 based on the speed of the recording sheet 9 detected by the sheet detection unit 12. And, when the sheet detection unit 10 detects the recording sheet 9 conveyed thereto, the controller 205 causes the switching circuit 84 to turn on after the period of time calculated by the timing control unit 83 has elapsed. Accordingly, a highly accurate timing control can be achieved.

In this example embodiment, the controller 205 corresponds to the configuration of the sheet conveying device employing a roller fixing method using the fixing roller 26 and the pressure roller 27. However, the controller 205 shown in FIG. 9 is applicable to the configuration of a sheet conveying device employing a belt fixing method. Further, the controller 205 can be applied to a configuration of an intermediate transfer unit serving as a sheet conveying device.

Figure 10:
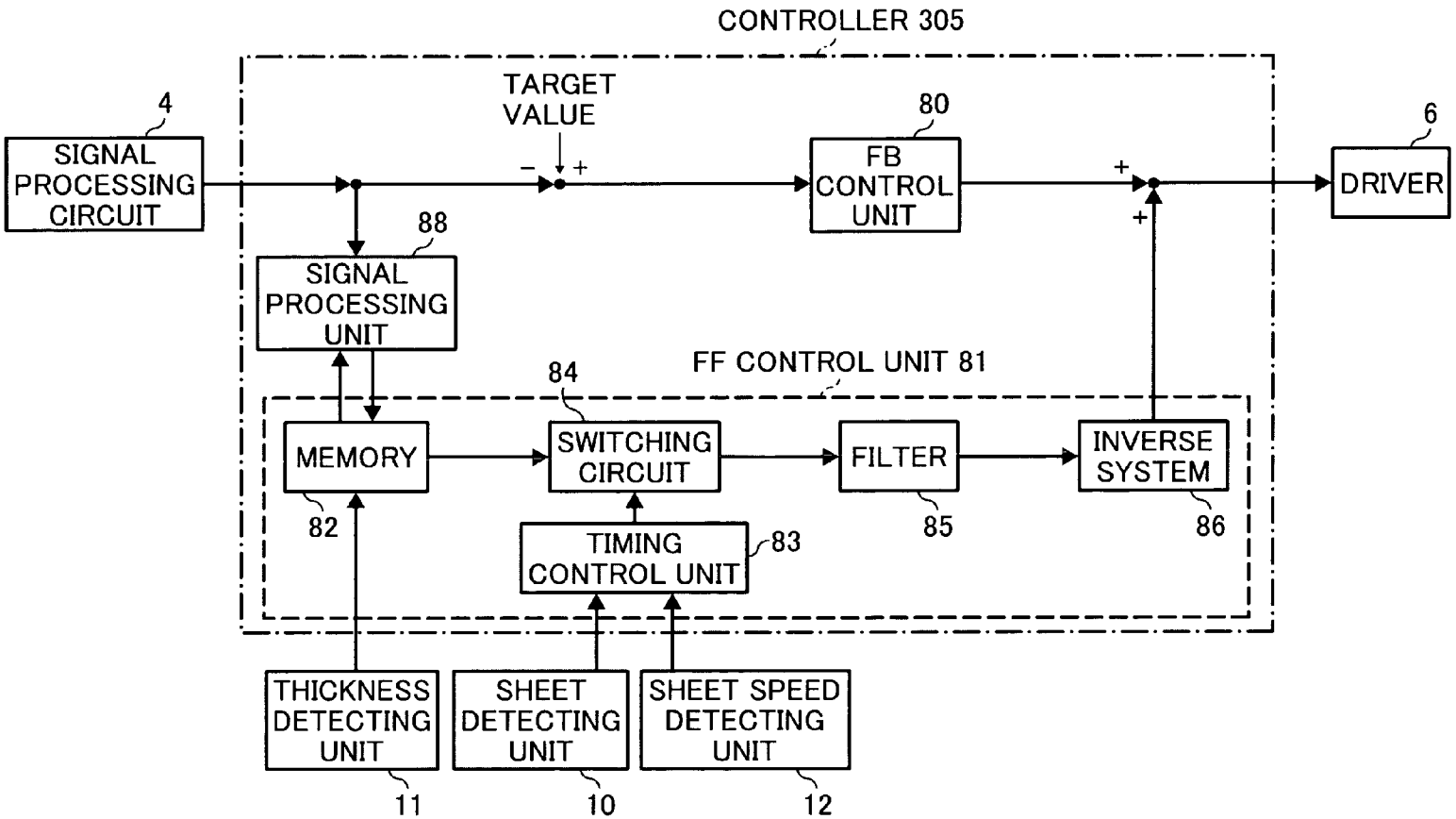
FIG. 10 is a block diagram of a controller included in another sheet conveying device according to an example embodiment of the present patent application.

Referring to FIG. 10, a block diagram of a configuration of a controller 305 controlling a sheet conveying device is described.

The configuration and functions of the controller 305 is basically same as the controller 5 of FIG. 4, the controller 105 of FIG. 7, and the controller 205 of FIG. 9, except that the controller 305 further includes a signal processing unit 88.

The signal processing unit 88 is disposed between the signal processing circuit 4 and the memory 82. The signal processing unit 88 is an arithmetic circuit having a memory, not shown, therein to convert the data on variations in speed of the pressure roller 27 detected by the encoder 3 and the signal processing circuit 4 to a feed-forward target value. In this example embodiment, the signal processing circuit 88 is disposed in the controller 305. However, as an alternative to the above-described location, the signal processing unit 88 can be outside the controller 305 as long as being in the image forming apparatus 1.

With the above-described signal processing unit 88, the image forming apparatus 1 can obtain the speed variation data while conducting the feed-forward control. By so doing, the image forming apparatus 1 can correct the feed-forward target value when the feed-forward control is not sufficiently performed.

Figure 11:
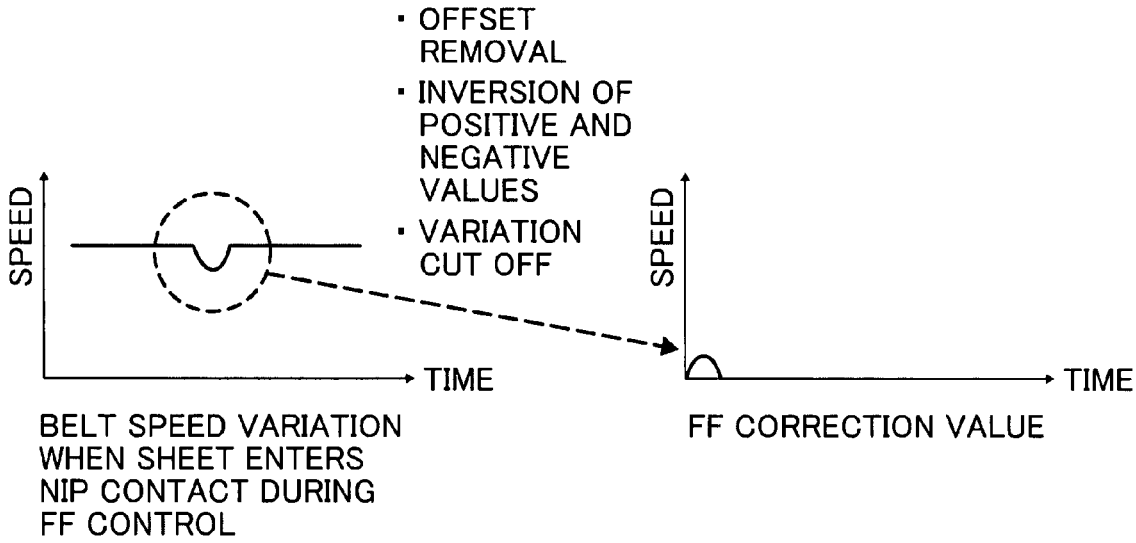
FIG. 11 is an illustration of a feed-forward target value stored in a memory of the controller of FIG. 10.

A description is now given of a correction of the feed-forward target value, with reference to FIG. 11.

The feed-forward target value can be corrected through the same processes of obtaining the feed-forward target value. Specifically, during the feed-forward control, data on variations in speed of the pressure roller 27 is detected by the encoder 3 and the signal processing circuit 4, and the speed variation data obtained during the feed-forward control is stored in the memory of the signal processing unit 88. Through the processes of removing offset from the detected speed variation data, inversing positive and negative values, and cutting off a part including the speed variation, the feed-forward correction value can be obtained, as shown in FIG. 11. The obtained feed-forward correction value is added to the feed-forward target value, thereby correcting the feed-forward target value.

Further, when there is room in the memory of the signal processing circuit 88 or any other memory, multiple feed-forward correction values are obtained and stored therein. Based on the multiple feed-forward correction values, an average value thereof can be obtained to correct the feed-forward target value. By obtaining the above-described average value based on the multiple feed-forward correction values, even when the result of each control has variation, the feed-forward target value can be corrected to a stable value.

Figure 12:
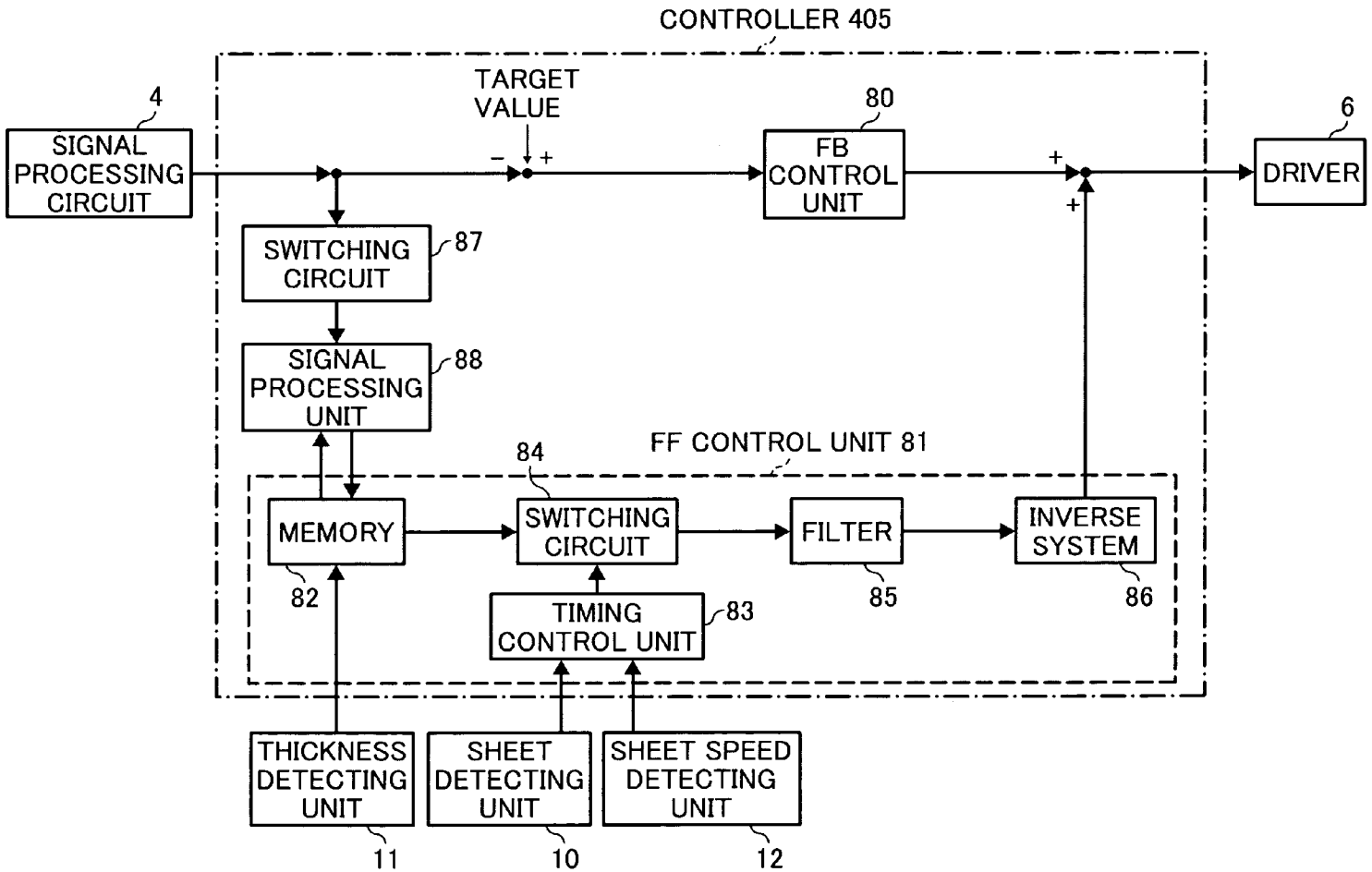
FIG. 12 is a block diagram of a controller included in another sheet conveying device according to an example embodiment of the present patent application.

FIG. 12 shows a configuration of a controller 405 according to another example embodiment of the present patent application.

The controller 405 shown in FIG. 12 has a basically similar configuration as the controller 305, except that the controller 405 further includes a switching circuit 87.

The switching circuit 87 has a function to cause an image forming apparatus to determine whether or not to correct the feed-forward target value, and may be disposed between the signal processing circuit 4 and the signal processing unit 88 as shown in FIG. 12. When a use selects a mode for not correcting the feed-forward target value, the controller 405 can cause the switching circuit 87 to turn off so as not to conduct the correction of the feed-forward target value. By so doing, a load to the arithmetic unit can be reduced, thereby reducing unnecessary power of consumption.

Further, the controller 305 shown in FIG. 10 can further include a mode having a function with which an image forming apparatus can change or add feed-forward target values. When the mode is selected, the image forming apparatus does not conduct the feed-forward control so as to feed a recording sheet having a thickness for obtaining the feed-forward target value thereof. The signal processing unit 88 calculates the feed-forward target value through processes same as the processes for obtaining the results as shown in FIG. 5, based on the speed variation data detected by the encoder 3 and the signal processing circuit 4, and stores or rewrites the results in the memory 82. By so doing, it is possible to add a feed-forward target value corresponding to a thickness that is not stored in memory and update the feed-forward target value on a regular basis.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present patent application, and all such modifications as would be obvious to one skilled in the art are intended to be included within the scope of the following claims.

What is claimed is:

1. A sheet conveying device, comprising:

a drive source;

a drive roller driven by the drive source;

a driven roller to press against the drive roller and rotate with the drive roller;

an angular velocity detector to detect an angular velocity of the drive roller;

a timing estimation unit to estimate a timing when a sheet-type recording medium enters between the drive roller and the driven roller; and a controller to control the drive source based on detection results obtained by the angular velocity detector, the controller including:

a feedback control unit to perform feedback control based on data obtained by the angular velocity detector, and a feed-forward control unit to perform feed-forward control based on data obtained by the timing estimation unit, wherein a feed-forward target value stored in the controller is corrected by detected speed variation data, wherein based on the detected speed variation data during the feed-forward control, a feed-forward correction value is obtained through processes of removing offset from detected speed variation data, inversing positive and negative values, and cutting off a part including the speed variation, and wherein the obtained feed-forward correction value is added to the feed-forward target value, thereby correcting the feed-forward target value.

2. The sheet conveying device according to claim 1, wherein the feed-forward control unit comprises:

a memory to store data on variations in speed of the drive roller previously obtained by the angular velocity detector at the timing when the sheet-type recording medium enters between the drive roller and the driven roller; and an arithmetic unit to calculate an input value to be inputted to the drive source to remove a variation in speed of the drive roller from the data on variations in speed of the drive roller stored in the memory.

3. The sheet conveying device according to claim 2, further comprising a thickness detection unit to detect a thickness of the sheet-type recording medium, wherein the input value calculated by the arithmetic unit to be inputted to the drive source is optimized according to the thickness detected by the thickness detection unit.

4. The sheet conveying device according to claim 3, wherein the memory stores data of various speed variations of the drive roller corresponding to various sheet-type recording media, appropriate data of speed variation corresponding to a most closely approximate thickness being output from the data of various speed variations stored in the memory to obtain the input value to be inputted to the drive source according to the thickness detected by the thickness detection unit.

5. The sheet conveying device according to claim 4, wherein the memory stores data of speed variations of the drive roller corresponding to at least two sheet-type recording media.

6. The sheet conveying device according to claim 2, wherein:

drive roller speed data obtained by the angular velocity detector at the timing when the sheet-type recording medium enters between the drive roller and the driven roller is stored in the memory; and the data on variations in speed of the drive roller previously stored in the memory is corrected based on the stored drive roller speed data.

7. The sheet conveying device according to claim 2, wherein:

drive roller speed data obtained by the angular velocity detector at the timing when the sheet-type recording medium enters between the drive roller and the driven roller is stored in the memory; and the feed-forward control is performed using the stored speed data and the data on variations in speed of the drive roller stored in the memory.

8. The sheet conveying device according to claim 2, wherein:

drive roller speed data obtained by the angular velocity detector at the timing when the sheet-type recording medium enters between the drive roller and the driven roller is stored in the memory multiple times; and the data on variations in speed of the drive roller stored in the memory is either corrected or expanded according to an average value of the speed data stored multiple times.

9. An image forming apparatus comprising the sheet conveying device according to claim 1, wherein the sheet conveying device includes a fixing unit.

10. An image forming apparatus comprising the sheet conveying device according to claim 1, wherein the sheet conveying device includes an intermediate transfer unit.

11. The sheet conveying device according to claim 1, wherein the feed-forward target value is corrected through a same process of obtaining the feed-forward control target value.

12. The sheet conveying device according to claim 11, wherein during the feed-forward control, data on variations in speed of the driven roller is detected by the angular velocity detector, and a signal processing circuit and the speed variation data obtained during the feed-forward control is stored in a memory of a signal processing unit.

13. The sheet conveying device according to claim 12, wherein when there is room in the memory of the signal processing unit, multiple feed-forward correction values are obtained and stored therein.

14. The sheet conveying device according to claim 13, wherein based on the multiple feed-forward correction values, an average value of the feed-forward correction value is obtained to correct the feed-forward target value.

15. The sheet conveying device according to claim 1, wherein the controller includes a switching circuit.

16. The sheet conveying device according to claim 15, wherein the switching circuit determines whether or not to correct the feed-forward target value.

17. The sheet conveying device according to claim 15, wherein the switching circuit is disposed between a signal processing circuit and a signal processing unit.

* * * * *